US011338339B2

(12) United States Patent
Opitz et al.

(10) Patent No.: US 11,338,339 B2
(45) Date of Patent: May 24, 2022

(54) COOLING A ROLL OF A ROLL STAND

(71) Applicant: Primetals Technologies Austria GmbH, Linz (AT)

(72) Inventors: Erich Opitz, Mönchhof (AT); Lukas Pichler, Linz (AT); Alois Seilinger, Linz (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 447 days.

(21) Appl. No.: 16/340,410

(22) PCT Filed: Oct. 12, 2017

(86) PCT No.: PCT/EP2017/076000
§ 371 (c)(1),
(2) Date: Apr. 9, 2019

(87) PCT Pub. No.: WO2018/073086
PCT Pub. Date: Apr. 26, 2018

(65) Prior Publication Data

US 2019/0308233 A1 Oct. 10, 2019

(30) Foreign Application Priority Data

Oct. 17, 2016 (EP) ..... 16194099

(51) Int. Cl.
*B21B 27/10* (2006.01)

(52) U.S. Cl.
CPC ..... *B21B 27/10* (2013.01); *B21B 2027/103* (2013.01)

(58) Field of Classification Search
CPC ... B21B 27/06; B21B 27/10; B21B 2027/103; B21B 45/0233
See application file for complete search history.

(56) References Cited

U.S. PATENT DOCUMENTS 1,994,721 A * 3/1935 Lorig ..... B21B 27/10 72/201
4,226,108 A * 10/1980 Wilmotte ..... B21B 27/10 72/201

(Continued)

FOREIGN PATENT DOCUMENTS

CN 2659573 Y * 12/2004
CN 2659573 Y 12/2004

(Continued)

OTHER PUBLICATIONS

Translation: Na et al, CN 2659573, Translated Jul. 1, 2021 (Year: 2004).*

(Continued)

*Primary Examiner* — Teresa M Ekiert
(74) *Attorney, Agent, or Firm* — Ostrolenk Faber LLP

(57) ABSTRACT

A cooling device (7) for cooling a roll (5) of a roll stand (1). The cooling device (7) includes a chilled beam (13) for receiving and discharging a coolant. The chilled beam (13) has multiple full jet nozzles (21) disposed on a discharge side (19) of the chilled beam (13), the side facing the roll (5) and extending parallel to a roll axis (17) of the roll (5). Through each of the full-jet nozzles, a jet of coolant having a nearly constant jet diameter can be sprayed from the chilled beam (13) towards the roll (5) in a discharge direction (23).

13 Claims, 7 Drawing Sheets

(56) References Cited

U.S. PATENT DOCUMENTS

| | | | | |
|---|---|---|---|---|
| 5,212,975 | A | 5/1993 | Ginzburg | |
| 5,265,441 | A | 11/1993 | Kramer | 62/374 |
| 6,062,056 | A * | 5/2000 | Groch | B21B 45/0218 72/201 |
| 6,450,000 | B2 | 9/2002 | Barten | 72/201 |
| 7,690,235 | B2 | 8/2010 | Buenten | |
| 8,281,632 | B2 | 10/2012 | Uijtdebroeks et al. | 72/201 |
| 8,438,891 | B2 | 5/2013 | Vanderschueren et al. | 72/201 |
| 9,421,593 | B2 | 8/2016 | Alken | |
| 9,868,142 | B2 * | 1/2018 | Chen | B21B 43/00 |
| 2001/0027672 | A1 | 10/2001 | Barten | 72/201 |
| 2010/0089112 | A1 | 4/2010 | Uijtdebroeks et al. | 72/201 |
| 2010/0180657 | A1 | 7/2010 | Vanderschueren et al. | 72/201 |
| 2016/0052033 | A1 | 2/2016 | Chen et al. | |

FOREIGN PATENT DOCUMENTS

| | | | |
|---|---|---|---|
| CN | 1956804 | A | 5/2007 |
| CN | 201534167 | U | 7/2010 |
| CN | 104602831 | A | 5/2015 |
| DE | 200 06 508 | U1 | 8/2000 |
| DE | 10 2009 053 074 | A1 | 9/2010 |
| EP | 2 792 428 | A1 | 10/2014 |
| GB | 2154897 | A | 9/1985 |
| JP | S51-79507 | U | 6/1976 |
| JP | S55-122609 | A | 9/1980 |
| JP | S58-128207 | A | 7/1983 |
| JP | S59-156506 | A | 9/1984 |
| JP | S60-190403 | U | 12/1985 |
| JP | S63-119917 | A | 5/1988 |
| JP | H06-170420 | A | 6/1994 |
| JP | H06-198314 | A | 7/1994 |
| JP | H10-291011 | A | 11/1998 |
| JP | 2001347307 | A | 12/2001 |
| JP | 2008-260047 | A | 10/2008 |
| JP | 2016-515474 | A | 5/2016 |
| KR | 20040055980 | A | 6/2004 |
| RU | 2 465 077 | | 10/2012 |
| WO | WO 2008/149195 | A1 | 12/2008 |
| WO | WO 2014/170139 | A1 | 10/2014 |
| WO | WO 2015/113832 | A1 | 8/2015 |

OTHER PUBLICATIONS

Chinese Office Action, dated Nov. 3, 2020, issued in corresponding Chinese Patent Application No. 201780064255.6. Total 13 pages.

Japanese Notice of Allowance, dated Dec. 21, 2020, issued in corresponding Japanese Patent Application No. 2019-520550. Total 3 pages.

Office Action dated Feb. 6, 2020 issued in corresponding Russian Patent Application No. 2019111288 with English translation.

Chinese Office Action, dated Mar. 4, 2020, issued in corresponding Chinese Patent Application No. 201780064255.6. Includes English translation. Total 15 pages.

International Search Report dated Mar. 6, 2018 in corresponding PCT International Application No. PCT/EP2017/076000.

Written Opinion dated Mar. 6, 2018 in corresponding PCT International Application No. PCT/EP2017/076000.

European Search Report dated Jun. 29, 2017 in corresponding European Patent Application No. 16194099.4.

Japanese Office Action, dated Oct. 5, 2020, issued in corresponding Japanese Patent Application No. 2019-520550. English translation. Total 7 pages.

Japanese Office Action, dated Jul. 13, 2020, issued in corresponding Japanese Patent Application No. 2019-520550. English Translation. Total 6 pages.

* cited by examiner

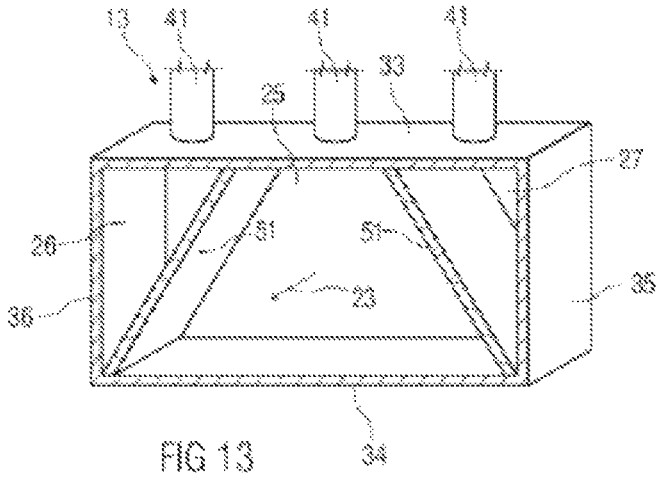
FIG 13
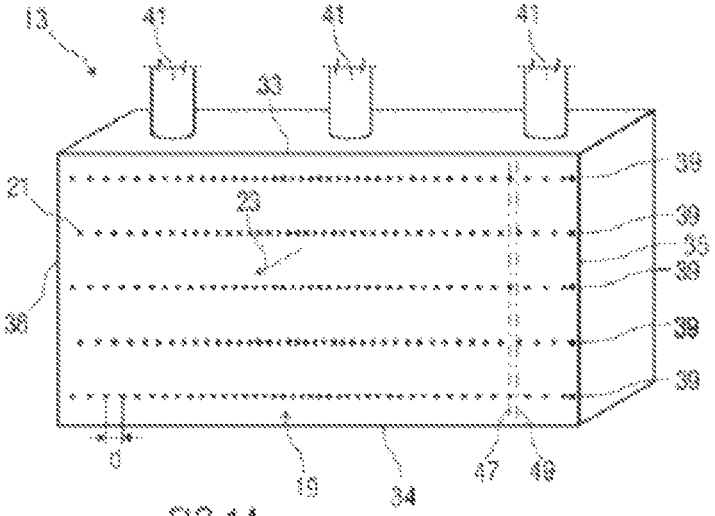
13
41
41
41
33
21
23
36
39
39
39

COOLING A ROLL OF A ROLL STAND

CROSS-REFERENCE TO RELATED APPLICATIONS

The present application is a 35 U.S.C. §§ 371 national phase conversion of PCT/EP2017/076000, filed Oct. 12, 2017, which claims priority of European Patent Application No. 16194099.4, filed Oct. 17, 2016, the contents of which are incorporated by reference herein. The PCT International Application was published in the German language.

TECHNICAL BACKGROUND

The invention relates to a cooling device for cooling a roll of a roll stand.

Roll stands for rolling rolling stock have rolls which are cooled with a cooling liquid, generally cooling water.

US 2010/0089112 A1 discloses rigid, concavely shaped shells, by means of which cooling liquid under low pressure can be applied to rolls of a roll stand.

DE 10 2009 053 074 A1 discloses flow cooling of work rolls of a roll stand by means of movable articulated cooling shells. In this case, the cooling liquid is applied predominantly under low pressure with the aid of the cooling shells, while cooling liquid is additionally applied under high pressure to produce a sufficient cooling effect.

JP H06-170420 (A) discloses a cooling device for cooling work rolls of a roll stand, which has a fixed spray bar that is slightly narrower than the narrowest strip produced with the roll stand concerned and has axially movable spray bars for cooling only those sections of the work rolls which correspond to the width of the strip currently being rolled.

JP S59-156506 A discloses a method for cooling a work roll of a roll stand in which cooling water is sprayed onto the work roll at low pressure, rather than high pressure, while at the same time the application area is enlarged.

WO 2014/170139 A1 discloses a spray bar for cooling rolling stock, which extends transversely to the direction of transfer of the rolling stock and has a central region and two edge regions, into each of which a cooling medium can be fed separately.

SUMMARY OF THE INVENTION

It is the underlying object of the invention to specify an improved cooling device for cooling a roll of a roll stand.

A cooling device according to the invention for cooling a roll of a roll stand comprises a cooling bar for receiving and discharging a coolant. The cooling bar has a plurality of full jet nozzles, which are arranged on a discharge side of the cooling bar. The discharge side faces the roll and extends parallel to a roll axis of the roll. Through each full jet nozzle, a coolant jet of the coolant with a nearly constant jet diameter can be discharged from the cooling bar toward the roll in a discharge direction.

A full jet nozzle is taken to mean a nozzle through which a substantially linear coolant jet with a nearly constant jet diameter can be discharged. By virtue of the concentrated discharge of the coolant, full jet nozzles produce a higher impact pressure on the roll than conventionally used fan jet nozzles at the same coolant pressure in the cooling bar. The higher impact pressure has a positive effect on the cooling action directly at the roll surface because there is always a certain coolant film with a typical thickness of several millimeters to centimeters there, owing to the large coolant quantity applied overall. This film should be penetrated as completely as possible by the impinging coolant jets in order to achieve good heat dissipation. Because of the high impact pressure, of the coolant jets on the roll, which pressure is produced by the full jet nozzles, the coolant pressure in the cooling bar can be significantly reduced as compared with the use of fan jet nozzles. This advantageously makes it possible to significantly reduce the energy consumption and operating costs of the cooling device.

Since the coolant is discharged through full jet nozzles, the spacing of the spray bar from the roll is furthermore uncritical within a wide range and therefore does not have to be matched to the roll diameter. Thus, for example, the substantially rectilinear coolant jets make it possible for the roll surface that is to be cooled to be at a distance of between 50 mm and 500 mm without any significant change in the cooling effect of the coolant jets.

Another advantage of using full jet nozzles is the reduction in maintenance expenditure resulting again from the reduced coolant pressure in the cooling bar since a reduction in the coolant pressure is also associated with a reduction in the loading and, as a result, the wearing of the nozzles.

One embodiment of the invention envisages that the interior of the cooling bar is divided into at least two mutually separate coolant chambers for receiving coolant. Each chamber is essentially an empty volume that is filled with liquid coolant that enters the chamber through its respective feed line 41.

Each coolant chamber corresponds to a respective subregion of the discharge side of the cooling bar. A plurality of full jet nozzles are arranged in the discharge side of the cooling bar.

The subregions are the external discharge side of the bar at the location on the discharge side of the respective chambers inside the bar. A coolant jet can be discharged from the coolant chamber toward the roll through each jet nozzle. Dividing the cooling bar into a plurality of mutually separate coolant chambers corresponding to different subregions of the discharge side of the cooling bar advantageously makes it possible to control the cooling effect of the subregions independently of one another. This is accomplished by controlling the coolant pressures in the subregions by controlling the pressure in the coolant chambers. As a result, the coolant flows discharged by the subregions are controlled independently of one another. It is thereby advantageously possible to influence the cooling of the roll in a location-dependent manner, ensuring that more intensely heated regions of the roll surface, e.g. a central region of the roll surface, are cooled more intensely than less intensely heated regions.

A development of the abovementioned embodiment of the invention envisages that a first coolant chamber corresponds to a first subregion of the discharge side of the cooling bar, wherein the first subregion is mirror-symmetrical with respect to a center line of the discharge side of the cooling bar, wherein the center line is perpendicular to the roll axis. For example, an extent of the first subregion parallel to the center line varies along the direction of the roll axis and is at a maximum along the center line. The first subregion has the shape of a polygon, for example. The mirror-symmetrical embodiment of the first subregion with respect to the center line takes account of the fact that the roll is generally likewise heated symmetrically with respect to the center line. The variation in the extent of the first subregion parallel to the center line along the direction of the roll axis with a maximum extent along the center line takes into account the fact that the roll is generally heated most strongly in the center and that the heating of the roll decreases toward the edge regions thereof.

The corresponding configuration of the first subregion therefore makes it possible to adapt the cooling of the roll to the location-dependent thermal loading of the roll by means of the first subregion.

Another embodiment of the invention envisages that each coolant chamber is connected to a coolant feed line for feeding coolant into the coolant chamber. The coolant feed line opens into the coolant chamber substantially perpendicularly to the discharge direction of the coolant. The opening of the coolant feed lines into the cooling bar substantially perpendicularly to the discharge direction allows a largely uniform pressure distribution of the coolant within each coolant chamber. A pressure gradient between full jet nozzles close to the opening and those remote from the opening is thereby advantageously avoided.

Another embodiment of the invention envisages that the coolant quantities fed into the coolant chambers can be controlled independently of one another by a respective control valve and/or by a respective pump. These both operate to control coolant flow into the coolant chamber, and the jet nozzles represent a hydraulic resistance in the coolant chambers against the pressurized inflow, causing each chamber to completely fill with coolant and also causes coolant outflow under pressure through all of the nozzles in the distribution side. This allows the above mentioned mutually independent control of the cooling effect of the coolant jets discharged from the individual coolant chambers. Control of the coolant quantities by control valves is particularly advantageous, for example, if a conventional coolant supply system that is present in any case, e.g. a water supply system, which usually delivers cooling water at a pressure of 4 bar, can be used on the rolling system concerned. In this case, it is possible to dispense with a complex and expensive pressure boosting system for supplying the roll cooling. Controlling the coolant quantities by means of pumps, if appropriate in conjunction with the control valves, makes it possible to switch off individual pumps or to reduce the power of the pumps in pauses between rolling or in the case of rolling campaigns in which only a low cooling capacity is required and thereby to lower energy consumption.

Another embodiment of the invention envisages an automation system for controlling the coolant quantities fed into the coolant chambers. It is thereby advantageously possible to automatically control coolant volume flows discharged from the coolant chambers to the roll in order to adapt the volume flows to a temperature distribution on the roll surface. In this case, the coolant quantities fed into the coolant chambers are preferably controlled by the automation system through control of the abovementioned control valves and/or pumps.

Another embodiment of the invention envisages that a nozzle spacing of mutually adjacent full jet nozzles along a direction parallel to the roll axis varies along that direction. In this case, the nozzle spacing is preferably smallest in a central region of the discharge side of the cooling bar. The nozzle spacing along a direction parallel to the roll axis is between about 25 mm and about 50 mm, for example. These embodiments of the invention also make it possible to adapt the arrangement of the full jet nozzles to the location-dependent thermal loading of the roll surface since the nozzle spacing along a direction parallel to the roll axis is varied in accordance with this thermal loading. A minimum nozzle spacing in the central region of the discharge side of the cooling bar takes account of the fact that the central region of the roll surface is generally subject to the greatest thermal loads.

Another embodiment of the invention envisages that the full jet nozzles are arranged in a plurality of mutually parallel nozzle rows. This advantageously allows coolant to be applied to the roll over a large area and, in conjunction with the rotation of the roll, in a uniform manner.

Another embodiment of the invention envisages that the cooling bar has a nozzle aperture for each full jet nozzle, in which the full jet nozzle is releasably secured. This embodiment of the invention advantageously enables faulty jet nozzles to be replaced easily.

Another embodiment of the invention provides a wiper for wiping coolant from the roll, wherein the wiper and the cooling bar can be pivoted jointly. By means of a wiper, it is advantageously possible to prevent too much coolant from being guided onto the rolling stock and/or into a rolling nip through which the rolling stock is guided between two rolls and washing away a lubricant for reducing the friction between the rolling stock and the rolls, for example. The joint pivotability of the wiper and of the cooling bar advantageously eliminates the need for an additional device for moving the cooling bar. In this case, the advantage, already mentioned above, of using full jet nozzles once again takes effect, namely that using full jet nozzles makes the distance between the spray bar and the roll uncritical over a wide range and therefore makes it unnecessary to adapt it to the roll diameter. Moreover, the invention is also particularly suitable as a retrofitted solution for existing rolling systems with wipers, wherein, for example, only the conventional high pressure spray bars need be replaced by the cooling bars according to the invention.

A roll stand according to the invention comprises a roll and two cooling devices according to the invention, wherein the two cooling devices are arranged on opposite sides of the roll. The advantages of a roll stand according to the invention result from the advantages already mentioned above of a cooling device according to the invention.

The above-described characteristics, features and advantages of this invention and the manner in which these are achieved will be more clearly and distinctly understood in connection with the following description of illustrative embodiments, which are explained in greater detail in conjunction with the drawings.

BRIEF DESCRIPTION OF THE DRAWINGS

In the drawings:

FIG. 4 shows the discharge side of a second illustrative embodiment of a cooling bar, FIG. 5 shows the discharge side of a third illustrative embodiment of a cooling bar, FIG. 6 shows the discharge side of a fourth illustrative embodiment of a cooling bar, FIG. 7 shows the discharge side of a fifth illustrative embodiment of a cooling bar, FIG. 8 shows the discharge side of a sixth illustrative embodiment of a cooling bar, FIG. 9 shows the discharge side of a seventh illustrative embodiment of a cooling bar, FIG. 10 shows the discharge side of an eighth illustrative embodiment of a cooling bar, FIG. 11 shows the discharge side of a ninth illustrative embodiment of a cooling bar, FIG. 12 shows the discharge side of a tenth illustrative embodiment of a cooling bar.

FIG. 13 shows a schematic perspective illustration of the cooling bar of FIG. 2 with the front discharge side removed, exposing the interior and the cooling chamber separating plates therein; and FIG. 14 shows a schematic perspective illustration of an eleventh illustration embodiment of a cooling bar with an array of jet nozzles modified from the first embodiment of FIG. 2.

DESCRIPTION OF EMBODIMENTS

In all the figures, corresponding parts are provided with the same reference signs.

Figure 1:
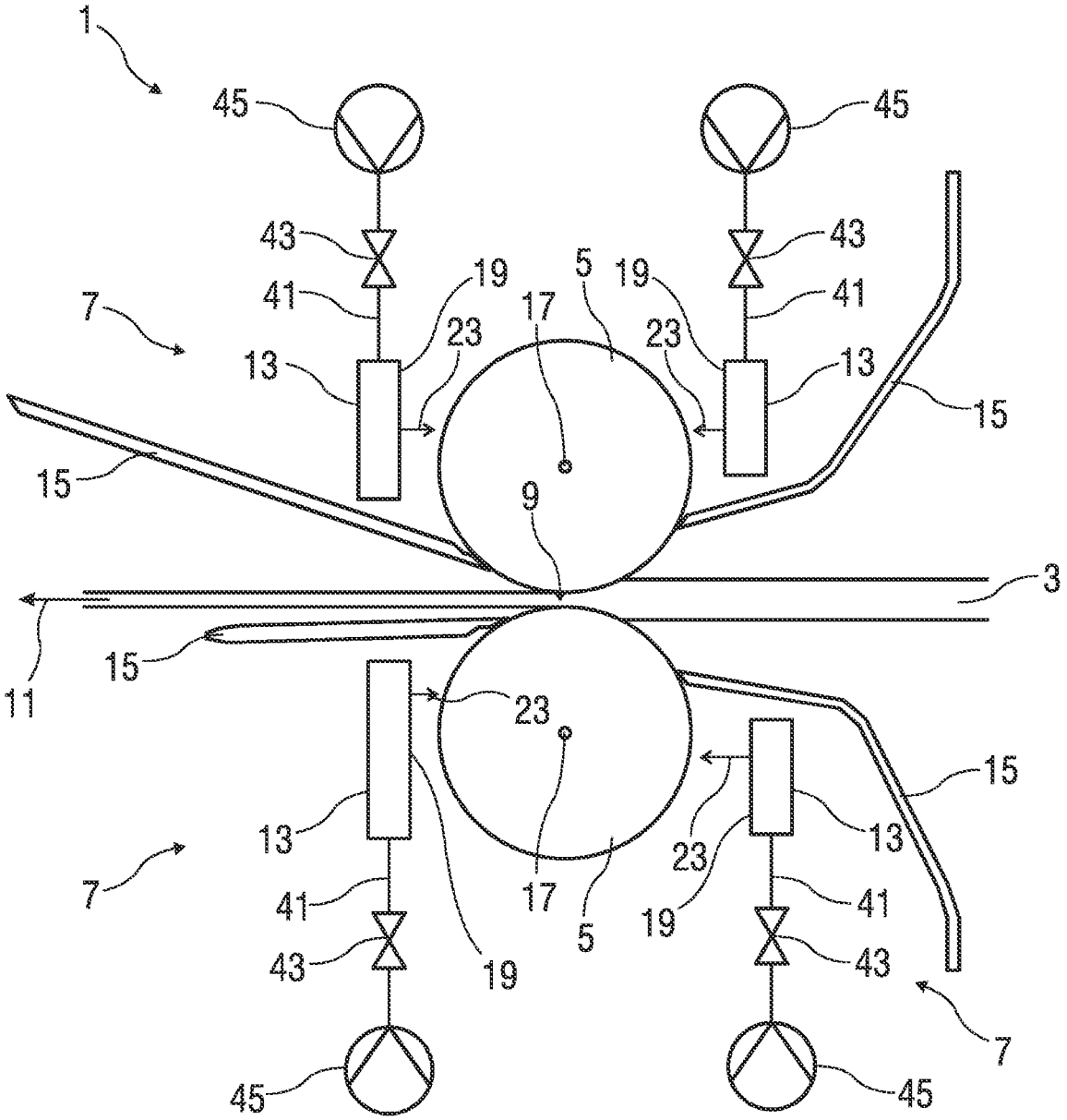
FIG. 1 shows schematically a roll stand with cooling devices.

FIG. 1 shows schematically a roll stand 1 for rolling rolling stock 3. The roll stand 1 comprises two rolls 5 in the form of work rolls and two respective cooling devices 7 for each roll 5. The cooling devices 7 are arranged on different sides of each roll 5. The rolls 5 are spaced apart by a rolling nip 9, through which the rolling stock 3 is passed in a rolling direction 11 in order to form the rolling stock 3.

Each cooling device 7 comprises a cooling bar 13 and a wiper 15 that wipes coolant off the surface of the roll rolling past the wipers.

Figure 2:
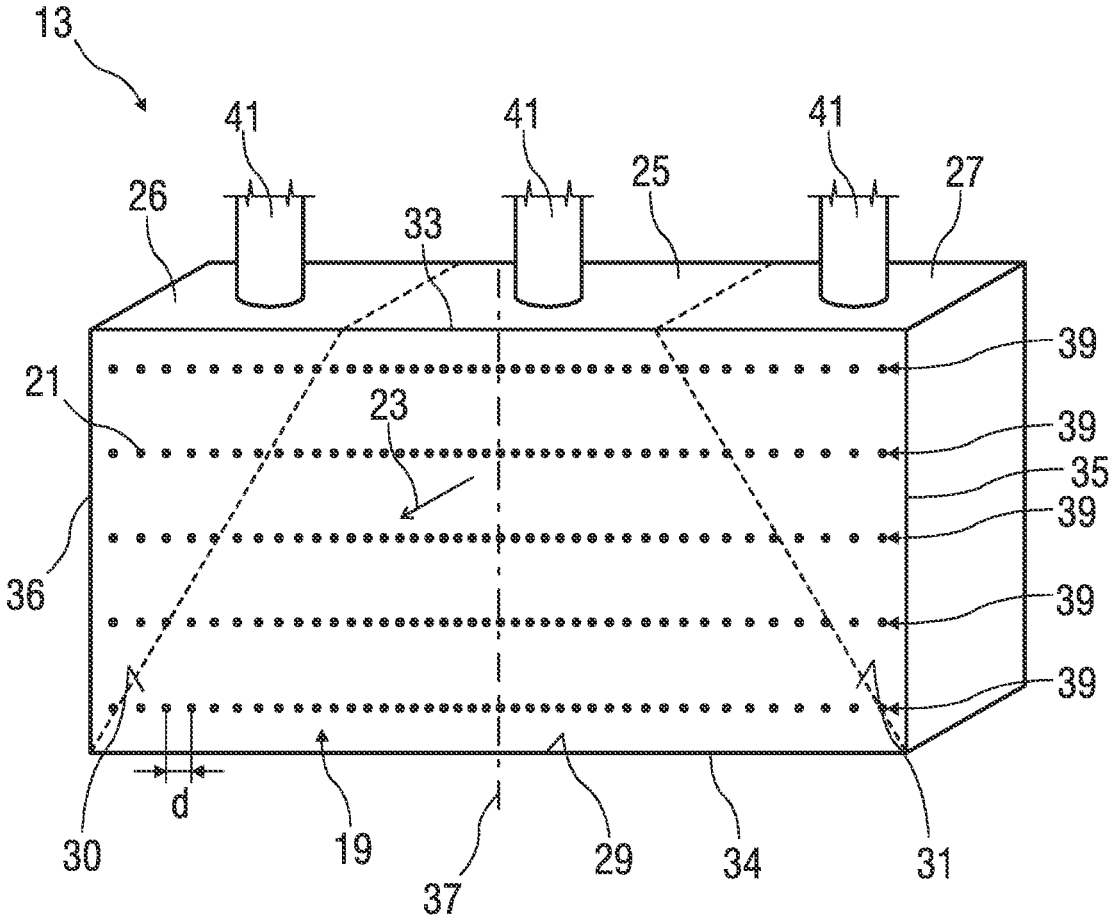
FIG. 2 shows a schematic perspective illustration of a first illustrative embodiment of a cooling bar.

Each cooling bar 13 is configured to receive a coolant from a source and to discharge the coolant. To discharge the coolant, FIG. 2 shows the cooling bar 13 with a plurality of full jet nozzles 39 arranged on a coolant discharge side 19 of the cooling bar 13. That discharge side faces the respective roll 5 and extends parallel to a roll axis 17 of the roll 5. Through each of the full jet nozzles, a coolant jet with a nearly constant jet diameter can be discharged from the cooling bar 13 toward the roll 5 in a discharge direction 23.

The coolant can be fed into the cooling bars 13 via coolant feed lines 41. The coolant quantities fed into the cooling bars 13 can be controlled by control valves 43 and/or by pumps 45, which are frequency-controlled, for example.

The pumps, valves and coolant supply control flows into the coolant chambers. These and the outlets from the nozzles represent a hydraulic resistance, together control coolant discharge, and therefore cause the chambers to be completely filled and enable coolant to exit from all nozzles. The coolant may be water, for example.

Each wiper 15 is configured to wipe coolant from the respective roll 5. The wipers can be pivoted toward the roll 5 and away from the roll 5. The cooling bars 13 and the wiper 15 of each cooling device 7 are preferably secured on a pivoting device of the cooling device 7, thus enabling the cooling bar 13 and the wiper 15 to be pivoted jointly toward the roll 5 and away from the roll 5.

FIG. 2 shows a schematic perspective illustration of a first illustrative embodiment of a cooling bar 13 for discharging coolant onto a roll 5. The cooling bar 13 is divided into three mutually separate coolant chambers 25, 26 and 27 arranged at respective locations in the bar, along the axis 17 of the roll. Each chamber is for receiving a respective supply of coolant.

Each coolant chamber may have its independent coolant flow, which controls the flow independently for each chamber, to adapt it to the temperature distribution of the roll being cooled.

Each coolant chamber 25, 26 and 27 corresponds to a respective subregion 29, 30 and 31 of and at the discharge side 19 in which a plurality of full jet nozzles 21 are arranged. The subregions are assigned to the respective chambers. The subregions are part of the outside surface 19 of the cooling bar and are separated from the chambers and by the wall of the side 19 of the bar. Through each nozzle, a coolant jet can be discharged from the coolant chamber 25, 26 and 27 toward the roll 5 in the discharge direction 23. This embodiment of the discharge side 19 has the shape of a rectangle with two longitudinal sides 33, 34 parallel to the roll axis 17 and two transverse sides 35, 36 perpendicular to the longitudinal sides.

A first coolant chamber 25 corresponds to and discharges through a first subregion 29 of the discharge side 19 of the cooling bar 13. The first subregion forms a central region of the discharge side 19. The first subregion 29 is mirror-symmetrical with respect to a center line 37 of the discharge side 19 of the cooling bar 13. The center line 37 of the bar 13 is oriented perpendicular to the roll axis 17 that is, the center line lies in a plane perpendicular to the roll axis.

The first subregion 29 has the shape of a trapezoid, which has two vertices which are situated on a first longitudinal side 33 and two vertices which are each situated at an end point of the second longitudinal side 34.

The full jet nozzles 21 are arranged on the discharge side 19 in a plurality of nozzle rows 39, and each row 39 extends parallel to the roll axis 17. In this case, a nozzle spacing d of adjacent full jet nozzles 21 in each nozzle row 39 varies symmetrically with respect to the center line 37. As a result, the adjacent nozzle spacing d is smallest in the central region of the discharge side 19 and increases, parabolically for example, toward the edge regions of the discharge side 19. In the illustrative embodiment illustrated in FIG. 2, the nozzle spacing d is twice as great at the ends of each nozzle row 39 as in the center of the nozzle row 39. The nozzle spacing d varies between 25 mm and 50 mm, for example. The nozzle rows 39 extend equidistantly apart substantially over the entire extent of the discharge side 19. Therefore, they produce a relatively uniform cooling effect on the roll surface of the respective roll 5.

A further development, not shown, of the illustrative embodiment shown in FIG. 2 envisages that the nozzle rows 39 are arranged offset relative to one another. Therefore, the full jet nozzles 21 of various nozzle rows 39 are not arranged along directions perpendicular to the roll axis 17. A particularly uniform cooling effect of the nozzle rows 39 is thereby advantageously achieved since "cooling channels" extending perpendicularly to the nozzle rows 39, in which no coolant is discharged onto the roll 5 are avoided. This would otherwise reduce the cooling effect. A cooling channel noted above is avoided with the offset. Without the offset, the spaces between nozzles that are not offset in successive rows do not receive coolant, causing formation of cooling marks on the rolls. Internal offset avoids that.

Moreover, full jet nozzles 21, which are very close to or on a boundary line between two adjacent subregions 29 31 in FIG. 2, are either omitted completely or arranged offset relative to the arrangement illustrated in FIG. 2 into one of the adjoining subregions 29, 30 and 31 since a corresponding subdivision of the interior of the cooling bar 13 into coolant chambers 25, 26 and 27, e.g. by separating plates 51 (FIG. 13), which plates extend along such a boundary line.

Each full jet nozzle 21 is mounted releasably, e.g. by means of a screwed joint, in a nozzle aperture of the cooling bar 13. The full jet nozzles 21 each have a nozzle cross section with a minimum diameter of about 4 mm, for example.

Each coolant chamber 25, 26 and 27 is connected to a coolant feed line 41 for feeding coolant into the coolant chamber 25, 26 and 27, wherein the coolant feed line 41 opens into the coolant chamber 25, 26 and 27 substantially perpendicularly to the discharge direction 23 of the coolant. The cross sections of the coolant feed lines 41 each have a diameter between 100 mm and 150 mm, for example.

The coolant quantities fed into the coolant chambers 25, 26 and 27 via the coolant feed lines 41 can be controlled independently of one another by a respective control valve 43 (illustrated in FIG. 1) and/or by a respective pump 45 (illustrated in FIG. 1). This advantageously makes it possible to adapt the coolant quantities discharged from the coolant chambers 25, 26 and 27 to the different thermal loads in various regions of the roll surface according to a cooling requirement for the rolls then in use.

Figure 3:
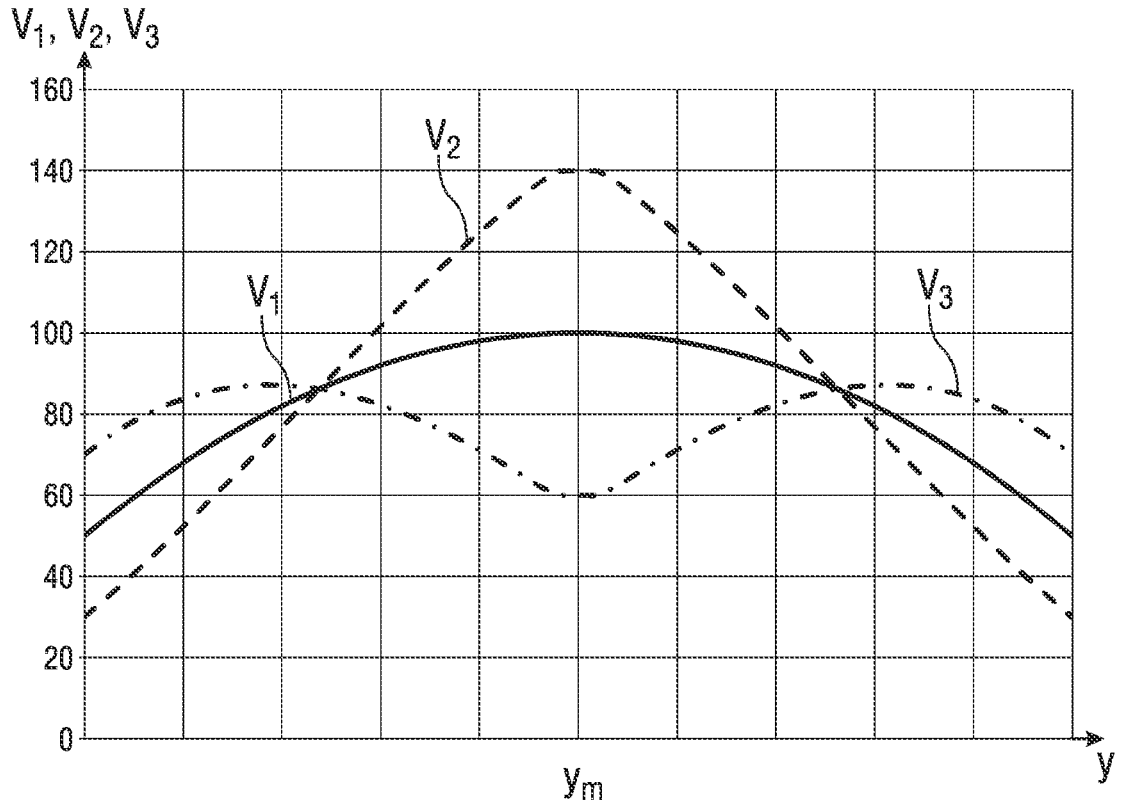
FIG. 3 shows volume flows of a coolant discharged by the cooling bar illustrated in FIG. 2 as a function of positions of nozzles along the lateral center line of the cooling bar.

FIG. 3 shows, by example, three coolant volume flows $V_1$, $V_2$, $V_3$ discharged from the cooling bar 13 illustrated in FIG. 2 as a function of a position y along a direction parallel to the roll axis 17, wherein the volume flows $V_1$, $V_2$, $V_3$ are indicated in percent relative to a rated flow.

The rated flow is the value of a first volume flow $V_1$ at a central position $y_m$. The first volume flow $V_1$ is produced if coolant is fed into all three coolant chambers 25, 26 and 27 with a certain rated pressure, which is the same for all the coolant chambers 25, 26 and 27. The first volume flow $V_1$ has a parabolic profile with a maximum in the central position $y_m$ and decreases from the central position $y_m$ toward the two end regions to half the value than in the central position $y_m$. The reason for this profile of the first volume flow $V_1$ is the doubling of the nozzle spacing d of the full jet nozzles 21 along the nozzle rows 39 from the center thereof to the two ends, wherein a parabolic increase in the nozzle spacing d has been assumed.

A second volume flow $V_2$ is produced if coolant is fed into the first coolant chamber 25 at a coolant pressure which is approximately twice as great as the rated pressure and coolant at a coolant pressure which is approximately half as great as the rated pressure is fed into each of the two other coolant chambers 26, 27.

A third volume flow $V_3$ is produced if coolant is fed into the first coolant chamber 25 at a coolant pressure which is approximately half as great as the rated pressure and coolant at a coolant pressure which is approximately twice as great as the rated pressure is fed into each of the two other coolant chambers 26, 27.

FIG. 3 shows that volume flows $V_1$, $V_2$, $V_3$, with different patterns of dependence on the position y along a direction parallel to the roll axis 17 can be produced by means of different coolant pressures in the coolant chambers 25, 26 and 27, with the result that the volume flow $V_1$, $V_2$, $V_3$ discharged from the cooling bar 13 can be adapted to the temperature distribution on the roll surface. The coolant pressure in each coolant chamber 25, 26 and 27 is set by the respective control valve 43 and/or by the respective pump 45.

FIGS. 4 to 12 each show the discharge side 19 of the respective other illustrative embodiment of a cooling bar 13. These illustrative embodiments differ from the illustrative embodiment in FIG. 2 only in the shape and number of the coolant chambers 25, 26 and 27 and the subregions 29, 30 and 31, corresponding thereto, of the discharge side 19. As in the illustrative embodiment illustrated in FIG. 2, the full jet nozzles 21 are each arranged in a plurality of nozzle rows 39, along which the nozzle spacing d in each case increases from the center toward the two ends. The full jet nozzles 21 in FIGS. 4 to 12 have therefore not been illustrated again. By virtue of the similar distribution of the full jet nozzles 21 on the discharge side 19 to the illustrative embodiment in FIG. 2, volume flows $V_1$, $V_2$, $V_3$ similar to FIG. 3 can be produced with each of the illustrative embodiments illustrated in FIGS. 4 to 12.

Like the illustrative embodiment illustrated in FIG. 2, the illustrative embodiments illustrated in FIGS. 4 to 10 each have three coolant chambers 25, 26 and 27 and subregions 29, 30 and 31, corresponding thereto, on the discharge side 19. Likewise as in the illustrative embodiment illustrated in FIG. 2, a first subregion 29 is mirror-symmetrical with respect to a center line 37, perpendicular to the roll axis 17, of the discharge side 19 of the cooling bar 13, and the two other subregions 30, 31 adjoin the first subregion 29 on different sides of the center line 37.

Each of FIGS. 4-12 show the discharge side without showing coolant spray nozzles that are along the entire length of the bar as illustrated in FIG. 2.

Figure 4:
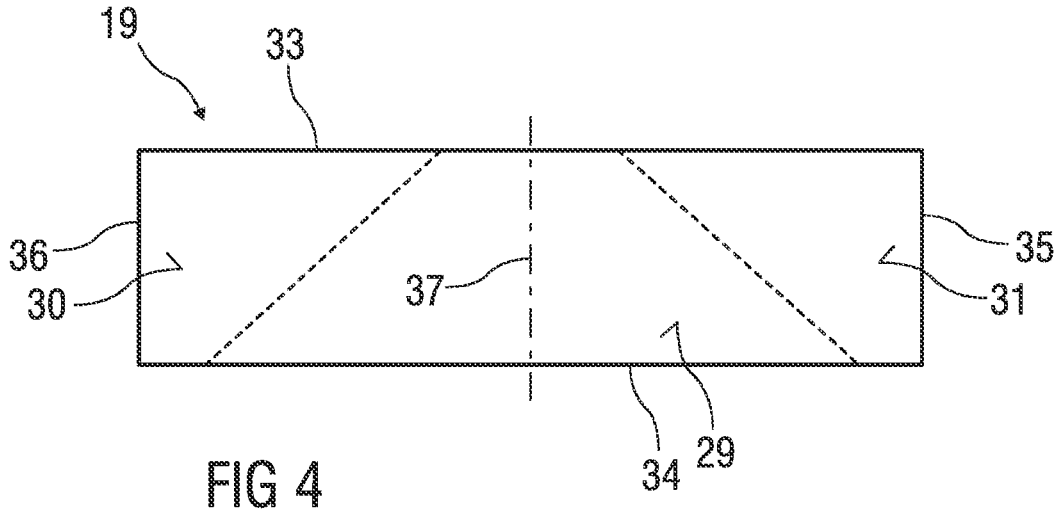
FIGS. 4-12 show discharge sides of respective cooling bars without showing the nozzles, which are shown in FIG. 2.

FIG. 4 shows an illustrative embodiment in which the first subregion 29 has the shape of a trapezoid, which has two vertices that are situated on a first longitudinal side 33 and two vertices that are situated on the second longitudinal side 34.

Figure 5:
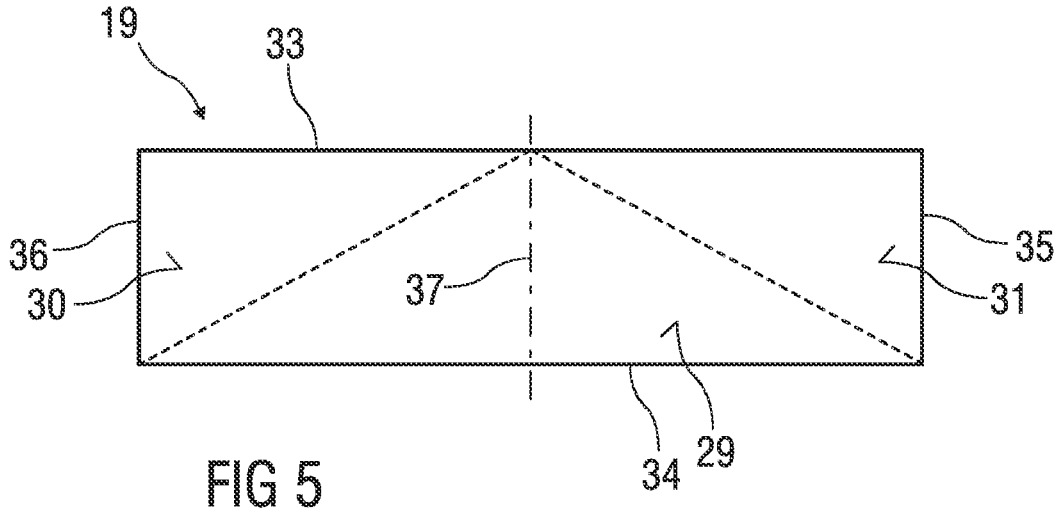

FIG. 5 shows an illustrative embodiment in which the first subregion 29 has the shape of a triangle, which has one vertex that is situated at the intersection between the center line 37 and the first longitudinal side 33 and two vertices that are situated at the ends of the second longitudinal side 34.

Figure 6:
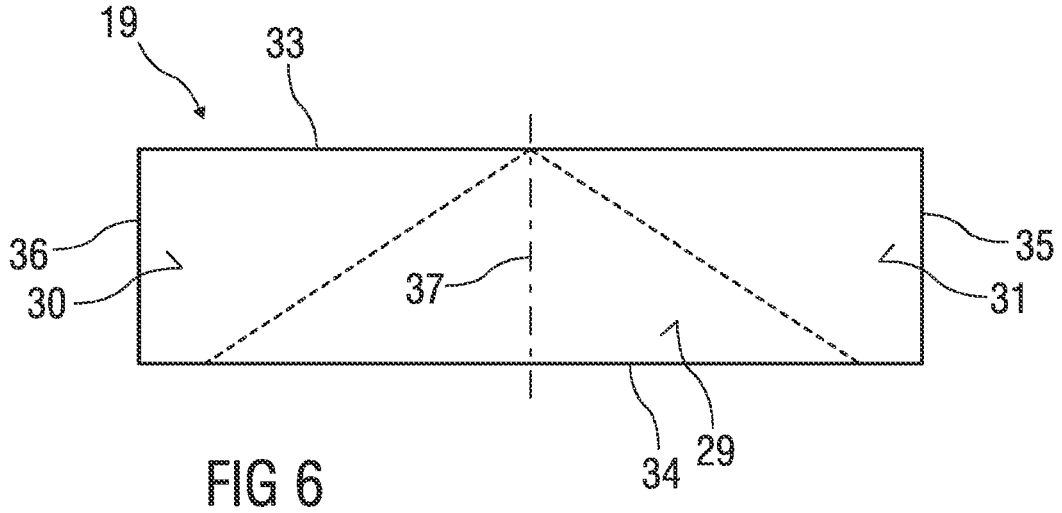

FIG. 6 shows an illustrative embodiment in which the first subregion 29 has the shape of a triangle, which has one vertex that is situated at the intersection between the center line 37 and the first longitudinal side 33 and two vertices that are situated on the second longitudinal side 34.

Figure 7:
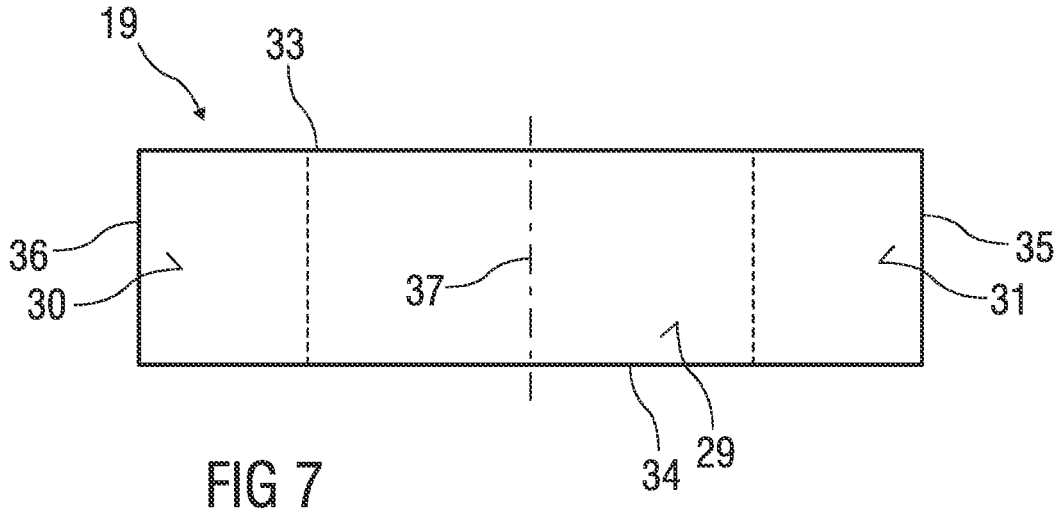

FIG. 7 shows an illustrative embodiment in which the first subregion 29 has the shape of a rectangle, the vertices of which are situated on the longitudinal sides 33, 34. In this illustrative embodiment, a discharge of coolant can be produced only from a central region of the discharge side 19 since no coolant is discharged via the two outer subregions 30, 31. This illustrative embodiment is therefore suitable particularly for rolling rolling stock 3 of different widths.

Figure 8:
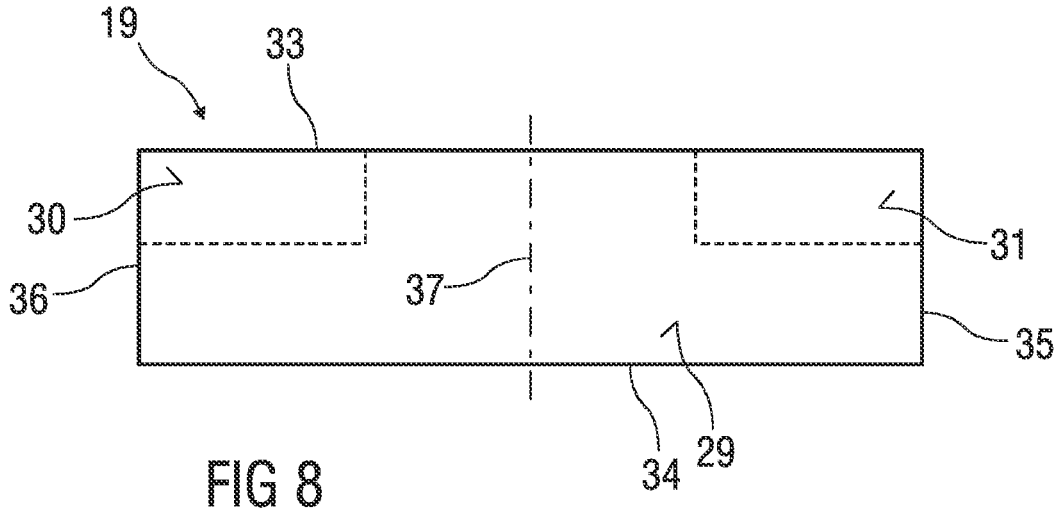

FIG. 8 shows an illustrative embodiment in which the second subregion 30 and the third sub-region 31 each have the shape of a rectangle which has a vertex on the first longitudinal side 33, a vertex that is situated at one end of the first longitudinal side 33 and a vertex that is situated on a transverse side 35, 36.

Figure 9:
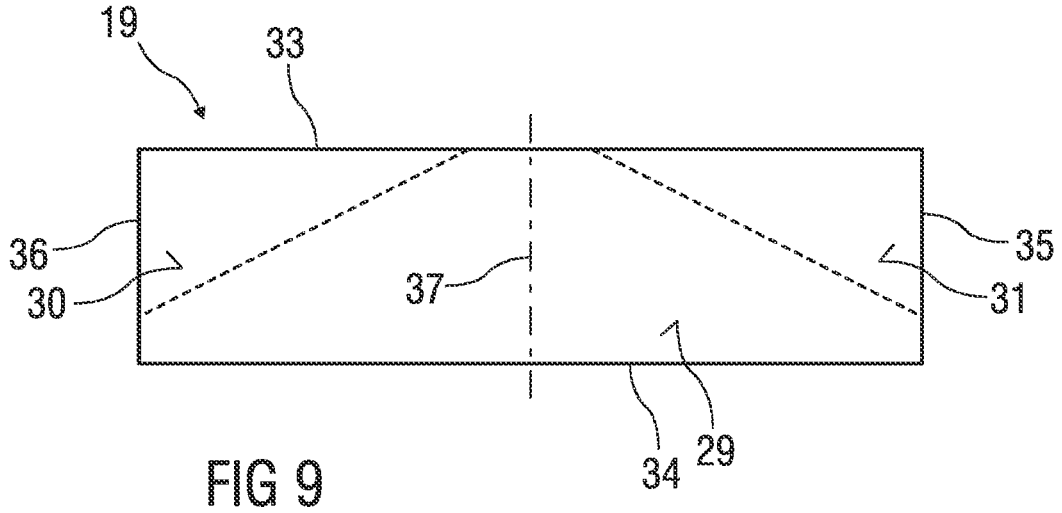

FIG. 9 shows an illustrative embodiment in which the first subregion 29 has the shape of a hexagon which has two vertices on the first longitudinal side 33, two vertices that are each situated at one end of the second longitudinal side 34 and a vertex on each transverse side 35, 36.

Figure 10:
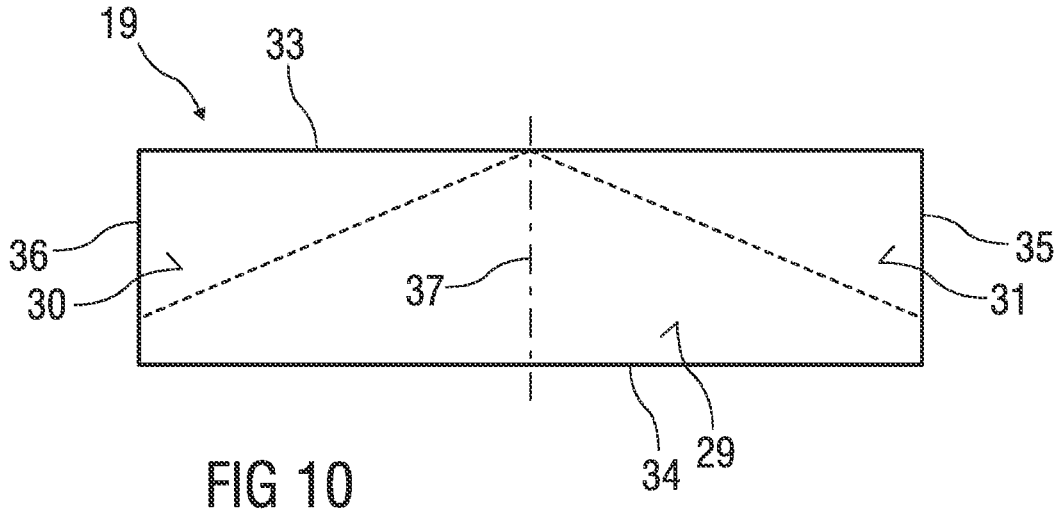

FIG. 10 shows an illustrative embodiment in which the first subregion 29 has the shape of a pentagon, which has one vertex that is situated at the intersection between the center line 37 and the first longitudinal side 33, two vertices that are each situated at one end of the second longitudinal side 34, and one vertex on each transverse side 35, 36.

Figure 11:
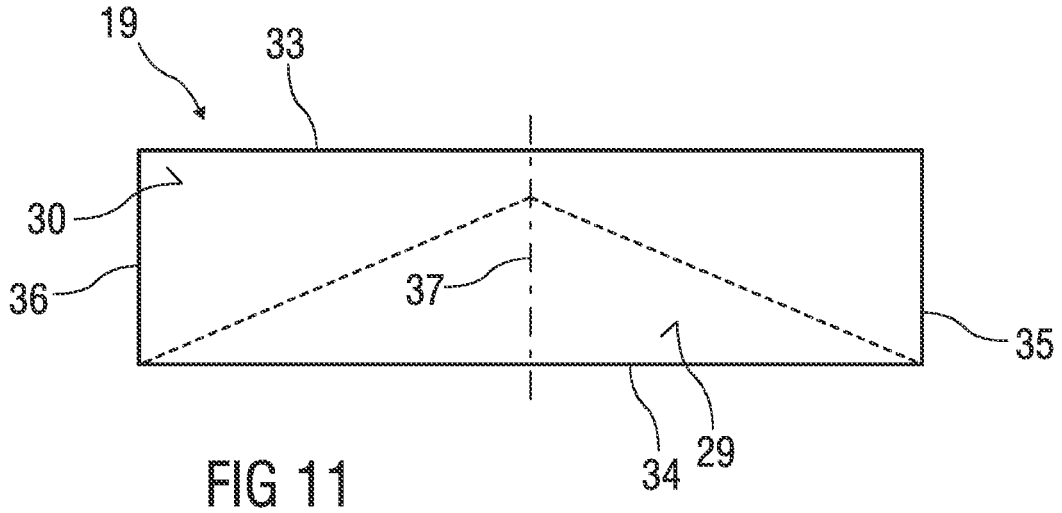
Figure 12:
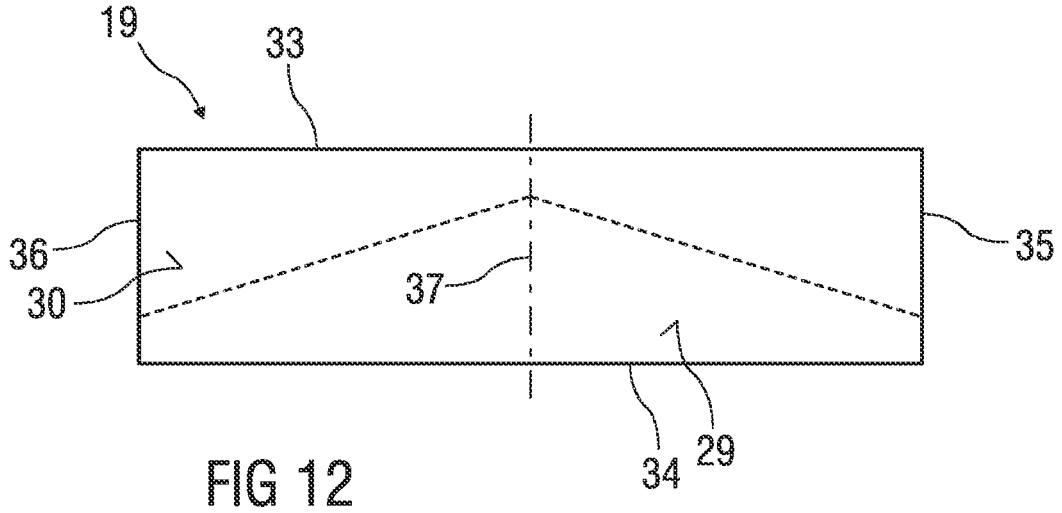

The illustrative embodiments illustrated in FIGS. 11 and 12 each have two coolant chambers 25, 26 and subregions 29, 30, corresponding thereto, on the discharge side 19. Both subregions 29 are mirror-symmetrical with respect to the center line 37, perpendicular to the roll axis 17, of the discharge side 19 of the cooling bar 13.

FIG. 11 shows an illustrative embodiment in which a first subregion 29 has the shape of a triangle, which has one vertex that is situated on the center line 37 and two vertices that are each situated at one end of the second longitudinal side 34.

FIG. 12 shows an illustrative embodiment in which a first subregion 29 has the shape of a pentagon which has one vertex that is situated on the center line 37, two vertices that are each situated at one end of the second longitudinal side 34 and a vertex on each transverse side 35, 36.

FIG. 13 shows an illustrative embodiment as in FIG. 2 with the front discharge side 19 of FIG. 2 removed so that the interior of the cooling bar is exposed to show two separating plates 51 extending across the interior, back to front, end thereby creates the separate cooling chambers 25, 26 and 27 from which coolant is expelled through the nozzles through the discharge side 19, and FIG. 14 shows the eleventh embodiment, similar to FIG. 2, but with the nozzles in vertically adjacent nozzle rows 39 offset along the axis of the cooling bar from the nozzles in adjacent rows from adjacent rows, as illustrated at 47 for nozzles in one row and 49 for nozzles in an adjacent offset row. This arrangement avoids cooling marks and cooling channels forming at the discharge side 19, as described above:

No two adjacent rows need have their respective nozzles vertically aligned in FIG. 14. Also, the schematic showing of subregions of the discharge side 39 shows a FIG. 2 is absent, as those lines in FIG. 2 are illustrated.

Although the invention has been illustrated and described in greater detail by preferred illustrative embodiments, the invention is not restricted by the examples disclosed, and other variations can be derived therefrom by a person skilled in the art without exceeding the scope of protection of the invention.

LIST OF REFERENCE SIGNS

1 roll stand
3 rolling stock
5 roll
7 cooling device
9 rolling nip
11 rolling direction
13 cooling bar
15 wiper
17 roll axis
19 discharge side
21 full jet nozzle
23 discharge direction
25 to 27 coolant chamber
29 to 31 subregion
33, 34 longitudinal side
35, 36 transverse side
37 center line
39 nozzle row
41 coolant feed line
43 control valve
45 pump
47 line depicting nozzle row offset
49 line depicting other nozzle row offset
51 separating plate
d nozzle spacing

The invention claimed is:

1. A cooling device for cooling a roll of a roll stand, the cooling device comprising:

a cooling bar configured for receiving and discharging a coolant; and the cooling bar having a coolant discharge side, a plurality of full jet nozzles arranged on the discharge side of the cooling bar, the discharge side facing the roll to be cooled and extending parallel to a roll axis of the roll, the bar is configured so that through each full jet nozzle, a coolant jet of coolant with a constant jet diameter can be discharged from the cooling bar toward the roll in a discharge direction, wherein the full jet nozzles are arranged in a plurality of parallel nozzle rows, wherein adjacent full jet nozzles have a nozzle spacing along a direction parallel to the roll axis and the spacing varies symmetrically with respect to a center line of the discharge side of the cooling bar along the direction of the roll axis, wherein the nozzles are arranged symmetrically with respect to an axis along the direction of the roll axis, and wherein the nozzle spacing is smallest in a central region of the discharge side of the cooling bar.

2. The cooling device as claimed in claim 1, further comprising:

the cooling bar is divided into at least two mutually separate coolant chambers for receiving the coolant, wherein each coolant chamber corresponds to a subregion of the discharge side of the cooling bar and a group of jet nozzles from the plurality of full jet nozzles is arranged in each subregion wherein, each nozzle is configured such that a coolant jet can be discharged from each coolant chamber toward the roll through each nozzle.

3. The cooling device as claimed in claim 2, further comprising a first one of the coolant chambers corresponds to a first one of the subregions of the discharge side of the cooling bar, the first subregion is mirror-symmetrical with respect to the center line of the discharge side of the cooling bar, which is perpendicular to the roll axis.

4. The cooling device as claimed in claim 2, wherein an extent of the first subregion parallel to the center line of the discharge side varies along the direction of the roll axis and is at a maximum along the center line.

5. The cooling device as claimed in claim 2, further comprising the first subregion has the shape of a polygon.

6. The cooling device as claimed in claim 2, further comprising a coolant feed line, connected to each coolant chamber and configured for feeding the coolant into the coolant chamber, wherein the coolant feed line opens into the coolant chamber in a direction substantially perpendicular to the discharge direction of the coolant.

7. The cooling device as claimed in claim 2, further comprising a control valve and/or a pump configured for controlling the coolant quantities fed into the coolant chambers, wherein the controlling is independent by the control valve and/or the pump.

8. The cooling device as claimed in claim 2, further comprising an automation system for controlling respective coolant quantities fed into the respective coolant chambers.

9. A roll stand comprising a roll and two of the cooling devices of claim 2, wherein the two cooling devices are arranged on opposite sides of the roll which the two devices cool.

10. The cooling device as claimed in claim 1, further comprising the nozzle spacing is between 25 mm and about 50 mm.

11. The cooling device as claimed in claim 1, wherein each full jet nozzle is releasably secured in a respective nozzle aperture therefore.

12. The cooling device as claimed in claim 1 further comprising a wiper for wiping coolant from the roll, wherein one or both of the wiper and the cooling bar are configured to be pivoted separately or jointly for positions for the wiping and halting the wiping.

13. The cooling device as claimed in claim 1, further comprising a respective plurality of rows of nozzles, the nozzle in each of the rows are spaced apart along a direction parallel to the roll axis and the nozzles in at least two adjacent rows of the nozzles are offset from a respective nozzle in an adjacent row, the offset selected such that coolant moving from one nozzle down the discharge side passes between two of the nozzles in the adjacent row of nozzles.

* * * * *